United States Patent [19]

Wilkerson

[11] 4,398,453

[45] Aug. 16, 1983

[54] FLUE PIPE CONNECTOR FOR A VENT CAP

[75] Inventor: Herman W. Wilkerson, Carmel, Ind.

[73] Assignee: Carrier Corporation, Syracuse, N.Y.

[21] Appl. No.: 306,986

[22] Filed: Sep. 30, 1981

[51] Int. Cl.[3] ..... F23L 17/02

[52] U.S. Cl. ..... 98/122; 98/61; 138/155; 285/307; 285/319; 285/DIG. 22

[58] Field of Search ..... 98/61, 122; 138/155; 285/305, 307, 317, 319, 420, DIG. 22

[56] References Cited

U.S. PATENT DOCUMENTS

| | | | |
|---|---|---|---|
| 753,096 | 2/1904 | Osteen | 285/319 |
| 951,889 | 3/1910 | Teher | 285/319 |
| 1,298,869 | 4/1919 | Bernier | 285/319 |
| 1,301,565 | 4/1919 | Jacobs . | |
| 1,345,778 | 7/1920 | Hrmel | 285/307 X |
| 1,441,967 | 1/1923 | Cowel . | |
| 1,661,674 | 3/1928 | Osborn . | |
| 1,791,255 | 2/1931 | Wacher | 285/DIG. 22 X |
| 2,099,984 | 11/1937 | Lundquist . | |
| 2,184,881 | 12/1939 | Martihet | 285/317 X |
| 2,336,656 | 12/1943 | Van Uum . | |
| 2,487,470 | 11/1949 | Osborn . | |
| 2,885,223 | 5/1959 | Duff . | |
| 3,149,362 | 9/1964 | Smithson . | |
| 3,543,670 | 6/1969 | Stone . | |
| 3,650,198 | 3/1972 | Stone . | |
| 3,842,721 | 10/1974 | Cardiff . | |
| 4,017,937 | 4/1977 | Hanold . | |

FOREIGN PATENT DOCUMENTS

| | | | |
|---|---|---|---|
| 684125 | 11/1939 | Fed. Rep. of Germany | 285/DIG.22 |
| 1191438 | 5/1970 | United Kingdom . | |

OTHER PUBLICATIONS

"Gas Vent Pipe and Fittings", GV-40, Selkirk Metalbestos, Wallace Murray, Form No. 25-128-0376.

*Primary Examiner*—Albert J. Makay
*Assistant Examiner*—Harold Joyce
*Attorney, Agent, or Firm*—Donald F. Daley; David L. Adour

[57] ABSTRACT

A vent cap having a quick release fastener for connecting the vent cap to a flue pipe of a furnace or other such combustion system is disclosed. The fastener is designed for attachment to a tubular stub connector of the vent cap and has a clip portion for engaging a slot in the flue pipe to lock the vent cap and flue pipe tigether between the clip portion and a shoulder portion of the fastener. The vent cap is easily disconnected from the flue pipe by rotating the vent cap about the longitudinal axis of the flue pipe to remove the clip portion of the fastener from the slot in the flue pipe and then, pulling the vent cap apart from the flue pipe.

4 Claims, 3 Drawing Figures

FLUE PIPE CONNECTOR FOR A VENT CAP

BACKGROUND OF THE INVENTION

The present invention relates to fasteners for connecting pipe sections, and more particularly relates to vent cap fasteners for connecting a vent cap to a flue pipe of a furnace or other such combustion system.

One situation in which it is especially desirable to provide a fastener for easily connecting and disconnecting tubular pipe sections is when it is desired to connect a vent cap, for example, a vent cap such as shown in U.S. Pat. No. 3,650,198 to Stone, to a flue pipe of a furnace or other such combustion system. One function of such a vent cap is prevent the influx of rain, foreign objects, and animals, such as birds, into the flue pipe. Therefore, the vent cap must be connected to the flue pipe so that the vent cap can not be easily blown or knocked off of the flue pipe. Furthermore, it is sometimes necessary to remove the vent cap to clean the flue pipe, to perform maintenance functions on the furnace, to install the furnace, or to add or replace component parts of the furnace. Thus, it is particularly desirable to provide a fastener which allows the vent cap to be easily removed from the flue pipe.

Many different kinds of fasteners are known for connecting sections of tubular pipes such as stove pipes and vacuum cleaner hoses. Some pipe sections are connected by fasteners which are welded or bolted to the pipes making it very difficult to connect and disconnect the pipes. Some fasteners are snap type fasteners which make it possible to easily connect the pipes but which make it somewhat difficult to disconnect the pipes. Fasteners which are designed for both easy connection and easy disconnection are usually relatively complex in construction and operation and are relatively expensive to manufacture.

SUMMARY OF THE INVENTION

Therefore, an object of the present invention is to provide a simple and relatively inexpensive quick release fastener for connecting pipe sections, such as sections of flue pipes and the like.

Another object of the present invention is to provide a vent cap having a quick release fastener for connecting the vent cap to a flue pipe of a furnace or other such combustion system.

These and other objects of the present invention are attained by a fastener comprising a resilient strip of material having an elongated middle or center portion, a shoulder portion extending substantially at right angles from one end of the center portion, a top or connector portion extending from the shoulder portion essentially parallel to the center portion, and a clip or bottom portion, having a smooth, rounded edge, extending from the other end of the center portion in substantially the same direction as the shoulder portion. The top or connector portion of the fastener is attached to a first pipe section, such as the tubular stub connector of a vent cap, by a fastening means such as a screw or rivet. The fastener is designed for connecting the first pipe section to a second pipe section, such as a flue pipe, having a slot spaced a selected distance from an end of the second pipe section. The middle portion is approximately equal in length to the distance between the slot and the end of the second pipe section.

The pipe sections are constructed so that the outside diameter of the first pipe section is only slightly less than the inside diameter of the second pipe section whereby the first pipe section may be snuggly inserted into the second pipe section. The pipe sections are connected by sliding the first pipe section into the second pipe section with the fastener aligned with the slot in the second pipe section so that the clip portion of the fastener slides over the outside surface of the second pipe section against the resilient action of the center portion until the clip portion snaps into the slot as the shoulder portion contacts the leading edge of the end of the second pipe section. When the pipe sections are pushed together in this manner the second pipe section is caught between the shoulder portion of the fastener and the edge of the clip portion of the fastener which is in the slot.

When connected, the pipe sections are locked into position with respect to vertical movements because the edge of the clip portion of the fastener catches the edge of the slot in the second pipe section if it is attempted to pull the pipe sections apart. If the pipe sections are pushed together, the edge of the end of the second pipe section abuts the shoulder portion of the fastener thereby preventing movement. However, the pipe sections may be quickly and easily disconnected by rotating the pipe sections relative to each other so that the smooth edge of the clip portion of the fastener rides over the edge of the slot against the resilient action of the center portion so that the clip portion is on the outside surface of the second pipe section. Then the pipes may be pulled apart because the clip portion no longer is caught in the slot.

The top portion of the fastener may be directly connected to the outside surface of the first pipe section or a slot may be cut in the first pipe section so that the top part may be inserted through the slot with the shoulder portion extending out back through the slot. Then, the top part may be fastened to the inside surface of the first pipe section.

BRIEF DESCRIPTION OF THE DRAWINGS

Other objects and advantages of the present invention will be apparent from the following detailed description in conjunction with the accompanying drawings in which.

DESCRIPTION OF THE PREFERRED EMBODIMENT

Figure 1:
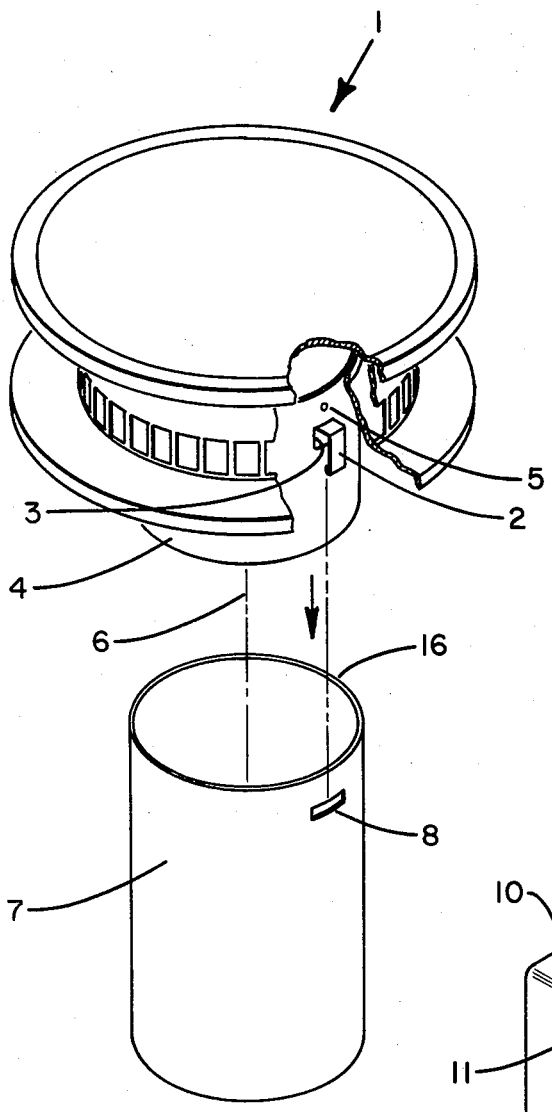
FIG. 1 shows a vent cap having a quick release fastener, constructed according to the principles of the present invention, for connecting thhe vent cap to the flue pipe.

Referring to FIG. 1, a vent cap 1 having a quick release fastener or vent cap connector 2, constructed according to the principles of the present invention, is shown. The fastener 2 has a top portion which can be passed through a slot 3 in a tubular stub connector 4 of the vent cap 1 for attachment to the tubular stub connector 4 by a rivet or screw 5. The fastener 2 is designed for connecting the vent cap 1 to a flue pipe 7 having a slot 8.

Figure 2:
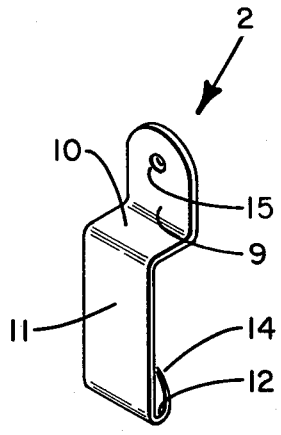
FIG. 2 shows a perspective view of the quick release fastener shown in FIG. 1.

Referring to FIG. 2, the details of the vent cap connector or fastener 2 are shown. The fastener comprises a resilient strip of material having a top or connector portion 9, a shoulder portion 10, a middle or center portion 11, and a clip or bottom portion 12 having a smooth, rounded edge 14. The top portion 9 has a hole 15 to facilitate the connection of the fastener 2 to the tubular stub connector 4 of the vent cap 1.

The shoulder portion 10 extends outward substantially perpendicular to the major surface of the top portion 9. The middle or center portion 11 extends downward from the shoulder portion 10 approximately parallel to the top portion 9. The middle portion 11 may be bent slightly inward, if desired, to increase the resiliency of this member. The clip or bottom portion 12 is bent upward back toward the shoulder portion 10. Preferably, as shown in FIG. 2, the clip portion 12 extends back toward the shoulder portion 10 at an angle of approximately 45° relative to the longitudinal axis of the middle portion 11 of the fastener 2. The clip portion 12 has a smooth, rounded edge 14 designed for engaging the slot 8 in the flue pipe 7 and the clip portion 12 is, preferably, slightly longer than the shoulder portion 10. The clip portion 12 may have only beveled side edges rather than a full smooth, rounded edge 14, if this type of construction is desired.

Referring to FIG. 1, the vent cap 1 and flue pipe 7 are aligned along the longitudinal axis 6 of the flue pipe 7. This is the position of the vent cap 1 and flue pipe 7 prior to these parts being connected by the fastener 2. The outside diameter of the tubular stub connector 4 is selected to be slightly less than the inside diameter of the flue pipe 7 so that the tubular stub connector 4 may be snuggly inserted into the flue pipe 7.

When the tubular stub connector 4 is inserted into the flue pipe 7 the clip portion of the fastener 2 rides over the outside surface of the flue pipe 7 against the resilient action of the middle portion 11 until the clip portion 12 engages the slot 8. The middle portion 11 is selected to have a length which is approximately equal to the distance between the slot 8 and the top edge 16 of the flue pipe 7. The clip portion 12 is biased inward by the middle portion 11 against the outer surface of the tubular stub connector 4 when the clip portion 12 engages the slot 8. In this position, as best shown in FIG. 3, the vent cap 1 is locked in position between the clip portion 12 and the shoulder portion 10 of the fastener 2.

Figure 3:
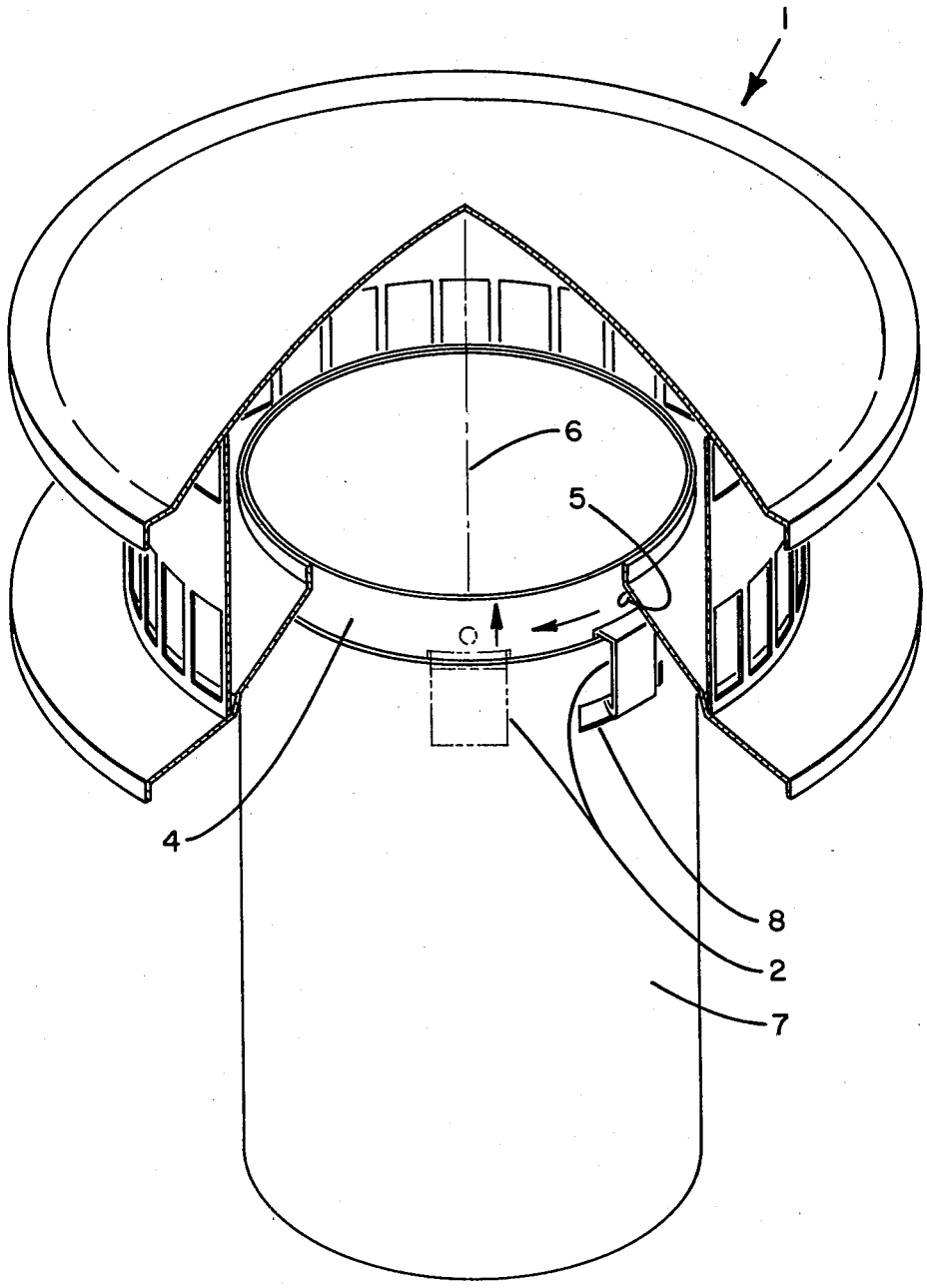
FIG. 3 shows the vent cap and flue pipe of FIG. 1 connected by the quick release fastener shown in FIG. 2.

Referring to FIG. 3, it is shown that the tubular stub connector 4 and flue pipe 7 are locked into position with respect to vertical movements because the edge 14 of the clip portion 12 catches the edge of the slot 8 in the flue pipe 7 if it is attempted to pull apart the tubular stub connector 4 and flue pipe 7. If the tubular stub connector 4 and flue pipe are pushed together, the edge 16 of the flue pipe 7 abuts the shoulder portion 10 of the fastener 2 thereby preventing this type of movement.

The vent cap 1 may be disconnected from the flue pipe 7 by rotating the vent cap 1 about the longitudinal axis 6 of of the flue pipe 7 as shown by the arrow in FIG. 3. As the vent cap 1 is rotated the smooth, rounded edge 14 of the clip portion 12 rides over the edge of the slot 8 onto the outside surface of the flue pipe 7 against the resilient action of the middle portion 11 of the fastener 2. The vent cap 1 may be rotated until the fastener 2 reaches a position as shown by the dashed lines in FIG. 3 and then the vent cap 1 may be pulled off of the flue pipe 7 as indicated by the vertical arrow shown in FIG. 3.

As shown in FIGS. 1 and 2, the top portion 9 of the fastener 2 is connected to the tubular stub connector 4 by passing the top portion 9 through a slot 3 in the tubular stub connector 4 and attaching the top portion 9 to the inside surface of the tubular stub connector 4 by a screw or rivet 5. However, if desired, the top portion 9 may be attached directly to the outside surface of the tubular stub connector 4 thereby eliminating the need for the slot 3.

It should be noted that other modifications of the present invention will be readily apparent to one of ordinary skill in the art. Therefore, while the present invention has been described in conjunction with a particular embodiment it is to be understood that various modifications and other embodiments of the present invention may be made without departing from the scope of the invention as described herein and as claimed in the appended claims.

What is claimed is:

1. A fastener for connecting pipe sections of the type wherein a first pipe section is inserted into a second pipe section having a slot spaced a selected distance from the leading edge of the second pipe section, said fastener comprising:

a top part for attaching the fastener to the surface of the first pipe section;

a shoulder extending outward from the top part, generally perpendicular to the surface of the first pipe section when the top part is attached thereto, for providing a stop when the two pipe sections are connected by the fastener;

a unitary middle part extending, generally parallel to the surface of the first pipe section, a distance approximately equal to the distance between the slot and the leading edge of the second pipe section; and a bottom part extending from the middle part back toward the shoulder, said bottom part having a smooth, rounded, outer edge which contacts the outside surface of the second pipe section to provide a surface for sliding contact between the smooth, rounded, outer edge of the bottom part and the outside surface of the second pipe section when the first pipe section is inserted into the second pipe section, and said bottom part biased inward by the middle part for engaging the slot in the second pipe section to catch the second pipe section between the shoulder and the smooth, rounded, outer edge of the bottom part of the fastener when the first pipe section is inserted into the second pipe section with the fastener aligned with the slot, whereby the pipe sections may be disconnected by rotating the first pipe section relative to the second pipe section to slide the smooth, rounded, outer edge of the bottom part of the fastener out of the slot onto the outside surface of the second pipe section so that the pipe sections may be pulled apart.

2. A flue pipe cap connector to releasibly secure a flue pipe cap to the end of a flue pipe wherein the flue pipe has a slot cut in the wall thereof a predetermined distance from the end of the flue pipe and wherein a tubular portion of the flue pipe cap extends into the flue pipe, said connector comprising:

a unitary strip of resilient material having an elongated center portion, a shoulder portion extending at essentially right angles from one end of said center portion, a connector portion extending from the end of the shoulder portion essentially parallel to the center portion, and a clip portion extending from the other end of the center portion back toward the shoulder portion, said clip portion being slightly longer than said shoulder portion, and said clip portion having a beveled outer edge which contacts the outside surface of the flue pipe to provide a surface for sliding contact between the beveled outer edge and the outside surface of the flue pipe; and a fastening means for securing the connector portion to the tubular portion of the flue pipe cap, said center portion being of a length essentially equal to the distance of the slot from the end of the flue pipe whereby when the tubular portion of the flue pipe cap is inserted into the flue pipe and the end of the flue pipe abuts the shoulder portion, the resilient action of the center portion forces the clip portion to extend into the slot and whereby rotation of the flue pipe cap within the flue pipe causes the beveled outer edge of the clip portion to ride out of the slot onto the outside surface of the flue pipe against the resilient action of the center portion.

3. A fastener as recited in claim 2 wherein the clip portion of the connector extends back toward the shoulder at an angle of approximately 45° relative to the longitudinal axis of the center portion of the connector.

4. A vent cap having a fastener for connecting the vent cap to a flue pipe having a slot spaced a selected distance from its leading edge, said vent cap comprising:

a top section having a tubular stub portion with a slot spaced a selected distance from the leading edge of the tubular stub portion;

a unitary strip of resilient material having an elongated center portion, a shoulder portion extending at essentially right angles from one end of said center portion, a connector portion extending from the end of the shoulder portion essentially parallel to the center portion, and a clip portion extending from the other end of the center portion back toward the shoulder portion, said clip portion being slightly longer than said shoulder portion and said clip portion having a smooth, rounded, outer edge which contacts the outside surface of the flue pipe to provide a surface for sliding contact between the smooth, rounded, outer edge of the clip portion and the outside surface of the flue pipe when the tubular stub portion of the vent cap is inserted into the flue pipe; and a fastening means for securing the connector portion of the unitary strip of resilient material to the inside surface of the tubular stub portion when the connector portion is inserted through the slot in the tubular stub portion, said center portion being of a length essentially equal to the distance between the leading edge of the flue pipe and the slot in the flue pipe whereby when the tubular stub portion of the vent cap is inserted into the flue pipe and the leading edge of the flue pipe abuts the shoulder portion of the resilient strip, the resilient action of the center portion forces the clip portion to engage the slot in the flue pipe and whereby rotation of the vent cap within the flue pipe causes the smooth, rounded, outer edge of the clip portion to ride out of the slot in the flue pipe onto the outside surface of the flue pipe against the resilient action of the center portion.

* * * * *